US008521069B2

(12) United States Patent
Hayashi et al.

(10) Patent No.: US 8,521,069 B2
(45) Date of Patent: Aug. 27, 2013

(54) DEVELOPING DEVICE AND IMAGE FORMING APPARATUS INCLUDING THE SAME

(75) Inventors: Shigeki Hayashi, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 328 days.

(21) Appl. No.: 13/112,437

(22) Filed: May 20, 2011

(65) Prior Publication Data

US 2011/0286770 A1 Nov. 24, 2011

(30) Foreign Application Priority Data

May 20, 2010 (JP) ..... 2010-116489

(51) Int. Cl.
*G03G 15/08* (2006.01)

(52) U.S. Cl.
USPC ..... 399/256

(58) Field of Classification Search
USPC ..... 399/254–256
See application file for complete search history.

(56) References Cited

U.S. PATENT DOCUMENTS 6,615,014 B2 9/2003 Sugihara
7,035,573 B2 * 4/2006 Yamaguchi et al. ..... 399/256
7,881,638 B2 * 2/2011 Noguchi et al. ..... 399/254
7,881,640 B2 * 2/2011 Iwata et al. ..... 399/254
2010/0226688 A1 * 9/2010 Soga ..... 399/254

FOREIGN PATENT DOCUMENTS

JP 5-197283 8/1993
JP 2009-109741 5/2009
JP 2010-160411 7/2010

* cited by examiner

*Primary Examiner* — David Gray
*Assistant Examiner* — Gregory H Curran
(74) *Attorney, Agent, or Firm* — Nixon & Vanderhye, P.C.

(57) ABSTRACT

A developing device to be installed in an electrophotographic image forming apparatus including a photoconductor drum that is to have an electrostatic latent image formed on a surface thereof, the developing device comprising: a developer vessel; a developing roller that is disposed in the developer vessel; first and second developer conveying passages; and first and second developer conveying helical members circulatory conveys the developer in the first and second developer conveying passages, wherein at least one of the first and second developer conveying helical members includes an end blade at one end at a downstream side in a conveying direction, wherein the end blade includes a circumferential-direction agitating blade portion whose radial projecting size gradually increases toward the downstream side in the conveying direction; and a helical blade portion integrally wound around an outer periphery of the circumferential-direction agitating blade portion.

14 Claims, 12 Drawing Sheets

DEVELOPING DEVICE AND IMAGE FORMING APPARATUS INCLUDING THE SAME

CROSS-REFERENCE TO RELATED APPLICATION

This application is related to Japanese patent application No. 2010-116489 filed on May 20, 2010 whose priority is claimed under 35 USC §119, the disclosure of which is incorporated by reference in its entirety.

BACKGROUND OF THE INVENTION

1. Field of the Invention

The present invention relates to a developing device using a dual-component developer and an image forming apparatus including the same.

2. Description of the Background Art

In recent years, for electrophotographic image forming apparatuses supporting full-color and high-quality images, a dual-component developer (hereinafter simply referred to as the "developer") which exhibits an excellent charge performance stability as to a toner is in widespread use.

The developer is made up of the toner and a carrier, which are agitated in a developing device and frictionally rubbed with each other to produce an appropriately electrified toner.

In the developing device, the electrified toner is supplied onto a surface of a developing roller. The toner is moved by an electrostatic attraction from the developing roller to an electrostatic latent image formed on a surface of a photoconductor drum.

Thus, a toner image based on the electrostatic latent image is formed on the photoconductor drum.

Further, there has been an increasing demand for the image forming apparatuses that operate faster and that are miniaturized, which is associated with the necessity to electrify the developer quickly and sufficiently and to convey the developer quickly.

To this end, Prior Art 1 proposes a circulative developing device including first and second developer conveying passages divided by a partitioning plate provided in a developer vessel, first and second communicating paths that allow the first developer conveying passage and the second developer conveying passage to communicate with each other at opposite ends, and first and second auger screws that are arranged in the first and second developer conveying passages to convey a developer in directions opposite to each other (for example, see Japanese Unexamined Patent Publication No. 2001-255723).

In the developing device described above, the developer in the first developer conveying passage is conveyed by the first auger screw to an interior wall of the developer vessel located at the most downstream side of the first developer conveying passage, and is pushed toward the first communicating path due to a pressure from the developer conveyed from the upstream side, thereby transferring to the second developer conveying passage.

On the other hand, the developer in the second developer conveying passage is conveyed by the second auger screw to the interior wall of the developer vessel at the downstream side of the second developer conveying passage, and is pushed toward the second communicating path due to a pressure of the developer conveyed from the upstream side, thereby transferring to the first developer conveying passage.

In this manner, the developer is circulated between the first developer conveying passage and the second developer conveying passage.

Prior Art 2 proposes a circulative developing device same as that in the Prior Art 1 except that, on helical blades of first and second auger screws, helical directions of helical blades at an end of the downstream side in a conveying direction of a developer are opposite (for example, see Japanese Unexamined Patent Publication No. 2009-109741).

In the developing device described above, the developer in the first developer conveying passage is conveyed to the helical blade, having the reverse helical direction, of the first auger screw, and then, pushed toward the first communicating path due to a pressure caused between the conveyed developer and a developer conveyed from the upstream side of the first developer conveying passage, thereby transferring to the second developer conveying passage.

On the other hand, the developer in the second developer conveying passage is conveyed to the helical blade, having the reverse helical direction, of the second auger screw, and then, pushed toward the second communicating path due to a pressure caused between the conveyed developer and a developer conveyed from the upstream side of the second developer conveying passage, thereby transferring to the first developer conveying passage.

In this manner, the developer is circulated between the first developer conveying passage and the second developer conveying passage.

However, in the developing devices described in Prior Art 1 and Prior Art 2, the developer receives a violent pressure in an advancing direction, and receives a shear force in such a pressurized state, at the position, facing the communicating path, at the end of the downstream side of the auger screw.

Due to a generation of heat and the shear force caused by a stress, a flow improver, which is an external additive of a toner, is unfavorably be embedded into a particle of a resin constituting the toner, which might cause an extreme deterioration in a flow property of the developer, and hence, a phenomenon in which the conveyance of the developer becomes difficult might be produced.

Consequently, it becomes difficult to supply the developer in a sufficient amount to a photoconductor drum through a developing roller, which might cause a problem that a density of an image printed on a recording medium is reduced.

SUMMARY OF THE INVENTION

The present invention has been made in consideration of the problem described in the foregoing, and an object thereof is to provide a developing device that can suppress a sharp pressure rise to a developer during a circulating conveyance in order to reduce a stress to the developer for preventing a deterioration in an image density, and an image forming apparatus including the same.

In order to achieve the above object, the present invention provides a developing device to be installed in an electrophotographic image forming apparatus including a photoconductor drum that is to have an electrostatic latent image formed on a surface thereof, the developing device including:

a developer vessel that accommodates a developer containing a toner and a carrier; a toner supply port for supplying the toner into the developer vessel; a developing roller that is disposed in the developer vessel and that rotates while carrying the developer to supply the toner onto the surface of the photoconductor drum having the electrostatic latent image formed thereon; a developer conveying passage that is disposed between a position in the developer vessel where the toner is supplied and the developing roller; a developer conveying helical member that is rotatably disposed in the developer conveying passage to convey the developer in the developer conveying passage to the developing roller, wherein the developer conveying passage includes: a first developer conveying passage associated with the toner supply port and a second developer conveying passage associated with the developing roller, the first developer conveying passage and the second developer conveying passage being defined by a partitioning plate extending in parallel to an axial direction of the developing roller; and a pair of communicating paths that establish a communication between the first developer conveying passage and the second developer conveying passage at opposite sides in the axial direction, and the developer conveying helical member includes a first developer conveying helical member disposed in the first developer conveying passage and a second developer conveying helical member disposed in the second developer conveying passage, wherein the first and second developer conveying helical members include a rotary shaft and a helical blade fixed to an outer peripheral surface of the rotary shaft, and at least one of the first and second developer conveying helical members includes an end blade at one end of the rotary shaft at a downstream side in a conveying direction of the developer, wherein the end blade includes a circumferential-direction agitating blade portion whose radial projecting size gradually increases toward the downstream side in the conveying direction; and a helical blade portion integrally wound around an outer periphery of the circumferential-direction agitating blade portion in the same helical direction as that of the helical blade, wherein, in the first and second developer conveying passages, the first and second developer conveying helical members convey the developer in directions opposite to each other, and the end blade agitates the developer in a circumferential direction of the rotary shaft at the downstream side in the conveying direction, such that the developer circulates through the first and second developer conveying passages.

Further, according to another aspect of the present invention, there is provided an image forming apparatus including: a photoconductor drum that is to have an electrostatic latent image formed on a surface thereof; a charging device that electrifies the surface of the photoconductor drum; an exposure device that forms the electrostatic latent image on the surface of the photoconductor drum; the developing device which supplies a toner to the electrostatic latent image on the surface of the photoconductor drum to form a toner image; a toner supplying device that supplies the toner to the developing device; a transferring device that transfers the toner image on the surface of the photoconductor drum to a recording medium; and a fusing device that fuses the toner image on the recording medium.

According to the developing device of the present invention, when the first developer conveying helical member has the end blade, for example, not only a force in the conveying direction by the helical blade portion of the end blade but also an agitating force in the circumferential direction of the rotary shaft by the circumferential-direction agitating blade portion are applied to the developer conveyed toward the downstream side of the first developer conveying passage by the first developer conveying helical member.

Therefore, the developing device according to the present invention can ease the pressure, which is applied to the developer conveyed toward the most downstream side of the first developer conveying passage because the developer is pressed against the interior wall of the developer vessel at the downstream side, so as to reduce a stress. As a result, the developing device of the present invention can smoothly transfer the developer toward the communicating path without being stayed, while reducing the deterioration in the flow property of the developer, at the downstream side of the first developer conveying passage.

This is also applied to the case in which the second developer conveying helical member includes the end blade.

Accordingly, the image forming apparatus provided with the developing device according to the present invention can allow the developer to smoothly circulate through the first developer conveying passage and the second developer conveying passage, whereby the developer in a sufficient amount is supplied to the photoconductor drum through the developing roller. Consequently, an image can be printed on a recording medium with a satisfactory image density.

DESCRIPTION OF THE PREFERRED EMBODIMENTS

Figure 1:
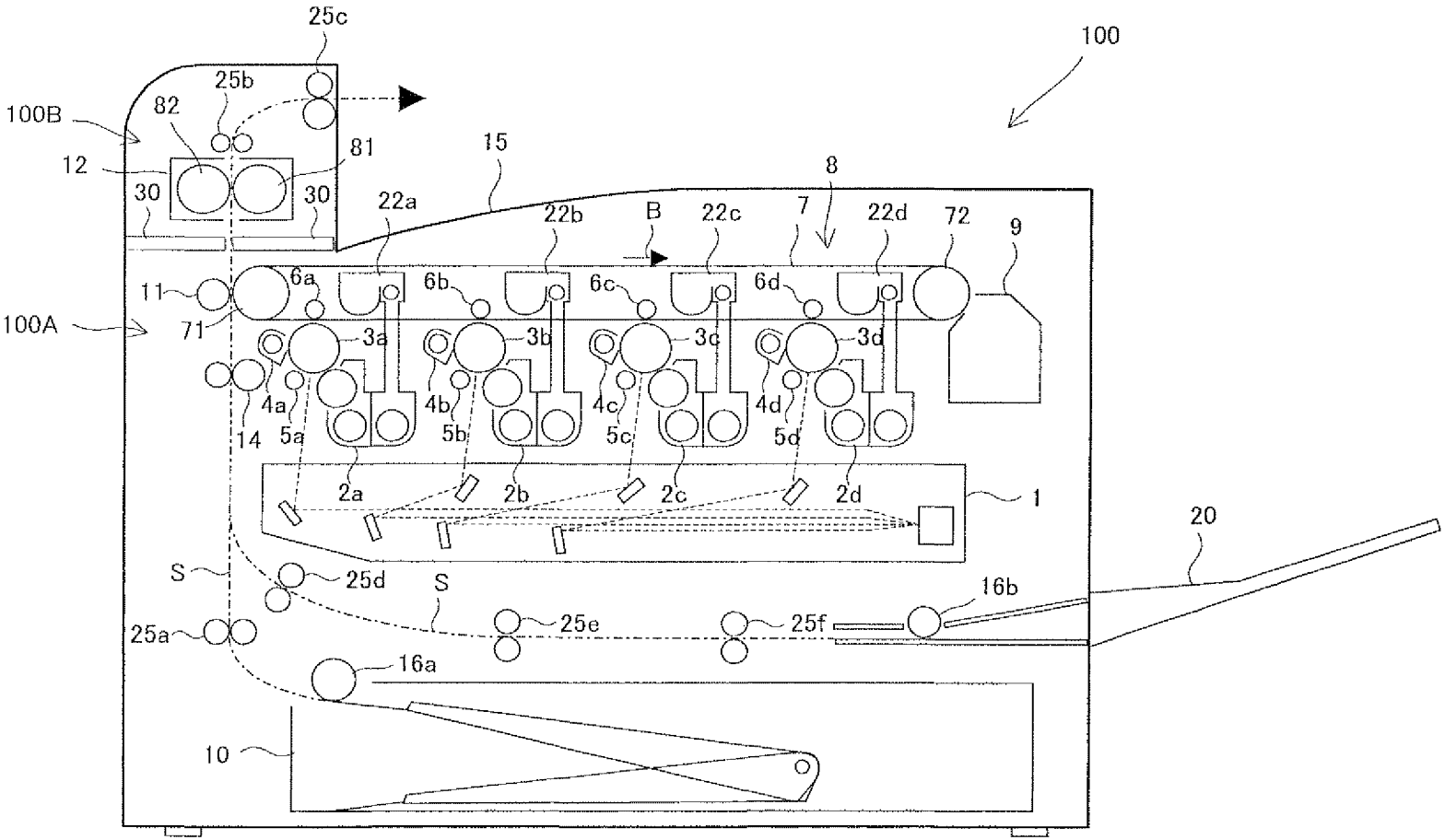
FIG. 1 is an explanatory illustration showing an overall structure of an image forming apparatus including a developing device according to a first embodiment of the present invention.

The developing device of the present invention is a circulative developing device including the developer vessel, the toner supply port, the developing roller, the first and second developer conveying passages, and the first and second developer conveying helical members, and is installed in the electrophotographic image forming apparatus such as a monochrome or full-color copier, printer, facsimile machine, or multi function peripheral possessing the functions of the foregoing apparatuses.

In the developing device described above, the first and second developer conveying helical members include the rotary shaft, and the helical blade mounted to the outer peripheral surface of the rotary shaft.

At least one of the first and second developer conveying helical members includes the end blade at one end of the rotary shaft at the downstream side in the conveying direction of the developer. From the viewpoint of further reducing the deterioration in the flow property of the developer, it is preferable that the end blade is mounted to both the first and second developer conveying helical members.

Hereinafter, the mere description of the "developer conveying helical member" indicates one or both of the first and second developer conveying helical members, and the mere description of the "developer conveying passage" indicates one or both of the first and second developer conveying passages.

The end blade of the developer conveying helical member includes the circumferential-direction agitating blade portion whose radial projecting size gradually increases toward the downstream side in the conveying direction; and the helical blade portion integrally wound around the outer periphery of the circumferential-direction agitating blade portion in the same helical direction as that of the helical blade. Specifically, the end blade can be configured as end blades A and B described below. The end blades A and B correspond to a first embodiment and a second embodiment described later.

<End Blade A>

The circumferential-direction agitating blade portion of the end blade A has plural projecting pieces provided on the rotary shaft with a predetermined space in the circumferential direction. A radial projecting size of each of these projecting pieces gradually increases toward the downstream side in the conveying direction. In other words, each of the projecting pieces is formed such that an area of a face arranged in the circumferential direction of the rotary shaft increases toward the downstream side.

With the structure of the end blade A described above, an agitating force (mainly, a force in the rotating direction) in the circumferential direction by the projecting pieces increases toward the downstream side at the position of the end blade A.

As a result, the pressure and stress applied to the developer because of the developer being pressed against the interior wall face of the developer conveying passage at the downstream side are decreased to reduce the deterioration in the flow property of the developer, whereby the developer can smoothly be transferred to the communicating path without being stayed at the downstream side of the developer conveying passage.

In this case, the projecting piece is formed into a right-angled triangle, or into a shape in which a long side of a right-angled triangle is in a step-like form.

The number of the projecting pieces is not particularly limited. It is preferable that two to four projecting pieces are equally spaced from the viewpoint of preventing the stay of the developer and of acquiring a sufficient agitating force in the circumferential direction of the rotary shaft.

When the number of the projecting pieces exceeds four, the gap formed between the adjacent projecting pieces becomes small, so that the developer is easy to be accumulated and stayed in the gap. On the other hand, when the number of the projecting pieces is less than two, the agitating force in the circumferential direction of the rotary shaft is significantly lowered.

It is suffice that the projecting pieces are arranged on a radial line with the center of the rotary shaft being defined as a center. The projecting pieces may tilt at an angle of up to about 15° with respect to the radial line in the circumferential direction (rotating direction or reverse rotating direction). Alternatively, the projecting pieces may totally be curved in the circumferential direction, wherein a base end thereof near the rotary shaft may be arranged on the radial line, and a tip end thereof may tilt at an angle of up to about 15° in the circumferential direction.

When the developer vessel includes the semicylindrical interior wall faces, each constituting the first and second developer conveying passages, a maximum radial projecting size of the projecting piece from the center of the rotary shaft is set to be 0.8 to 0.9 times the distance from the center of the rotary shaft to the semicylindrical interior wall face.

With this structure, the maximum radial projecting size of the projecting piece has an appropriate length, whereby the agitating force for the developer can sufficiently be acquired, while suppressing the stress to the developer.

When the maximum radial projecting size of the projecting piece from the center of the rotary shaft exceeds 0.9 times the distance from the center of the rotary shaft to the semicylindrical interior wall face, a shear force caused between the semicylindrical interior wall face and the projecting piece increases, which might increase the stress to the developer. When the maximum radial projecting size of the projecting piece from the center of the rotary shaft is less than 0.8 times, the agitating force applied to the developer cannot sufficiently be acquired.

When the end blade A is used, it is preferable that the rotary shaft rotates such that the projecting pieces direct toward the communicating path from above. With this structure, the developer on the outer periphery of the developer conveying helical member moves in the rotating direction, whereby the pressure caused at the downstream side of the developer conveying passage is easy to escape in the space in the communicating path. Therefore, a local pressure rise can effectively be suppressed.

It may be configured such that the helical directions of helical blade 112*a* and the helical blade portion 112*db* are made opposite to each other, and the rotary shaft may rotate in order that a projecting piece 112$da_1$ directs toward the communicating path from below. However, with this structure, the helical blade portion 112*db* that integrally rotates with the projecting piece 112$da_1$ applies a force to the developer in the vicinity of a terminal of the helical blade portion 112*db* in the direction in which the helical blade portion 112*db* pushes the developer into a corner of the developer vessel 111. As a result, the developer, which is pushed into the corner of the developer vessel 111 and has nowhere to go, is liable to be susceptible to an excessive stress. Accordingly, it is preferable that the rotary shaft rotates in such a manner that the projecting piece 112$da_1$ directs toward the communicating path from above.

<End Blade B>

The circumferential-direction agitating blade portion of the end blade B has a conic part provided to the rotary shaft in such a manner that the outer diameter thereof gradually increases toward the downstream side in the conveying direction; and has plural notches that are formed on the outer peripheral surface of the conic part with a prescribed space in the circumferential direction so as to extend in the axial direction of the rotary shaft.

Even with the structure of the end blade B described above, the agitating force in the circumferential direction by the projecting pieces increases toward the downstream side at the position of the end blade B, like the end blade A. In this case, the outer peripheral surface of the conic part expands in the radial direction toward the downstream side, so that the developer also receives a force in the direction of moving the developer in the radial direction along the outer peripheral surface of the conic part.

As a result, the pressure and stress applied to the developer because of the developer being pressed against the interior wall face of the developer conveying passage at the downstream side are decreased to reduce the deterioration in the flow property of the developer, whereby the developer can smoothly be transferred to the communicating path without being stayed at the downstream side of the developer conveying passage.

In this case, the conic part can be formed into a shape of a frustum of cone or frustum of pyramid such as a frustum of triangular pyramid, or a frustum of square pyramid. When the conic part is formed into a truncated pyramid, it is preferable that the notch is formed at the position of the surrounding corner portions of the truncated pyramid, because this structure easily applies the agitating force in the circumferential direction to the developer.

The shape of the cross-section of the notch, i.e., the shape of the cross-section parallel to the vertical surface with respect to the axial direction of the rotary shaft, is not particularly limited. However, a shape having a vertical internal face vertical with respect to the rotating direction of the rotary shaft is preferable. Examples of the shape described above include a V-shaped cross-section, L-shaped cross-section, or U-shaped cross-section.

With this structure, the developer can be pressed by the internal face of the notch through the rotation of the rotary shaft, whereby the agitating force in the circumferential direction can easily be applied to the developer.

The number of the notches is not particularly limited. However, it is preferable that two to four notches are equally spaced on the conic part from the viewpoint of preventing the stay of the developer and of acquiring a sufficient agitating force in the circumferential direction of the rotary shaft.

When the number of the notches exceeds four, the space between the adjacent notches becomes small, so that the developer is easy to be accumulated and stayed in the notches. On the other hand, when the number of the notches is less than two, the agitating force in the circumferential direction of the rotary shaft is significantly lowered.

When the developer vessel includes the semicylindrical interior wall faces, each constituting the first and second developer conveying passages, the maximum radial projecting size of the conic part from the center of the rotary shaft is set to be 0.8 to 0.9 times the distance from the center of the rotary shaft to the semicylindrical interior wall face.

With this structure, the maximum radial projecting size of the conic part has an appropriate length, whereby the agitating force for the developer can sufficiently be acquired, while suppressing the stress to the developer.

When the maximum radial projecting size of the conic part from the center of the rotary shaft exceeds 0.9 times the distance from the center of the rotary shaft to the semicylindrical interior wall face, a shear force caused between the semicylindrical interior wall face and the conic part increases, which might increase the stress to the developer. When the maximum radial projecting size of the conic part from the center of the rotary shaft is less than 0.8 times, the agitating force in the circumferential direction applied to the developer cannot sufficiently be acquired.

When the end blade B is used, it is also preferable that the rotary shaft rotates such that the notches direct toward the communicating path from above. With this structure, the developer on the outer periphery of the developer conveying helical member moves in the rotating direction, whereby the pressure caused at the downstream side of the developer conveying passage is easy to escape in the space in the communicating path. Therefore, a local pressure rise can effectively be suppressed.

It may be configured such that the helical directions of a helical blade 212*a* and a helical blade portion 212*db* are made opposite to each other, and the rotary shaft may rotate in order that notches $\mathbf{212}da_{22}$ direct toward the communicating path from below. However, with this structure, the helical blade portion 212*db* that integrally rotates with the notches $\mathbf{212}da_{22}$ applies a force to the developer in the vicinity of a terminal of the helical blade portion 212*db* in the direction in which the helical blade portion 212*db* pushes the developer into a corner of the developer vessel 111. As a result, the developer, which is pushed into the corner of the developer vessel 111 and has nowhere to go, is liable to be susceptible to an excessive stress. Accordingly, it is preferable that the rotary shaft rotates in such a manner that the notches $\mathbf{212}da_{22}$ direct toward the communicating path from above.

<Helical Blade Portion>

The helical blade portion of the end blade has a constant outer diameter, and has a width in the radial direction that gradually decreases toward the downstream side in the conveying direction.

With this structure, a conveying capability of the helical blade portion in the conveying direction gradually decreases toward the downstream side in the conveying direction, and the agitating force in the circumferential direction by the circumferential-direction agitating blade portion relatively increases. Accordingly, the stress to the developer can effectively be eased, while preventing the stay of the developer at the downstream side of the developer conveying passage.

In the following, with reference to the drawings, embodiments of a developing device of the present invention and an image forming apparatus including the same will be described in detail.

First Embodiment

FIG. 1 is an explanatory illustration showing an overall structure of an image forming apparatus including a developing device according to a first embodiment of the present invention.

An image forming apparatus 100 is a printer capable of forming a multi-color or single-color image on a sheet-like recording medium (recording sheet) based on image data externally received, the image forming apparatus 100 including: a developing device housing 100A in which a plurality of developing devices 2*a* to 2*d* are each accommodated in a casing; a fusing device housing 100B in which a fusing device 12 is accommodated above the developing device housing 100A inside the casing; and a partition wall 30 disposed between the developing device housing 100A and the fusing device housing 100B for insulating the heat generated by the fusing device 12.

A top face of the developing device housing 100A positioned beside the fusing device housing 100B serves as a sheet exit tray 15.

In the present embodiment, the printer is shown as an example of the image forming apparatus. On the other hand, the image forming apparatus can be a copier, a facsimile machine or a multi function peripheral possessing functions of the foregoing apparatuses, that can form a multi-color or single-color image on a recording medium based on image data externally received and/or image data read from an original by use of a scanner.

[Developing Device Housing]

As shown in FIG. 1, the developing device housing 100A chiefly accommodates: four photoconductor drums 3*a*, 3*b*, 3*c*, and 3*d*; four chargers (charging devices) 5*a*, 5*b*, 5*c*, and 5*d* that respectively electrify surfaces of the photoconductor drums 3*a* to 3*d*; an exposure unit (exposure device) 1 that forms an electrostatic latent image on each of the surfaces of the photoconductor drums 3*a* to 3*d*; four developing devices 2*a*, 2*b*, 2*c*, and 2*d* that accommodate corresponding ones of toners of black, cyan, magenta and yellow to develop the electrostatic latent images on the surfaces of corresponding ones of the photoconductor drums 3*a* to 3*d* to thereby form toner images; cleaner units 4*a*, 4*b*, 4*c*, and 4*d* that remove remaining toners on the surface of each of the photoconductor drums 3*a* to 3*d* after development and image transfer operations are carried out; four toner supplying devices 22*a*, 22*b*, 22*c*, and 22*d* that supply corresponding ones of the four-color toners to corresponding ones of the developing devices 2*a* to 2*d*; an intermediate transfer belt unit (transferring device) 8 that transfer the toner images on the surfaces of the photoconductor drums 3*a* to 3*d* to a recording medium; and an intermediate transfer belt cleaner unit 9.

The developing device housing 100A further includes: a sheet feeding tray 10 disposed at a bottommost position in the developing device housing 100A to store a plurality of recording media; a manual sheet feeding tray 20 disposed on one side of the developing device housing 100A such that a recording medium of an arbitrary size is set thereon; and a sheet conveying path S for conveying a recording medium from the sheet feeding tray 10 or the manual sheet feeding tray 20 to the intermediate transfer belt unit (transferring device) 8.

As used herein, as to members denoted by reference character associated with "a" to "d", "a" refers to those members for forming a black image, "b" refers to those members for forming a cyan image, "c" refers to those members for forming a magenta image, and "d" refers to those members for forming a yellow image.

That is, the image forming apparatus 100 is structured such that, based on image data for each of black, cyan, magenta, and yellow color components, a black toner image, a cyan toner image, a magenta toner image and a yellow toner image are selectively formed on the surfaces of the photoconductor drums 3*a* to 3*d*, and the formed toner images are overlaid one over another on the intermediate transfer belt unit 8, so as to form a full-color image on the recording medium.

Because the photoconductor drums 3*a* to 3*d* corresponding to respective colors are of the same structure, the description thereof will collectively be given employing a unified reference character "3". Similarly, the description will collectively be given employing a unified reference character "2" as to the developing devices; a unified reference character "5" as to the chargers; a unified reference character "4" as to the cleaner units; and a unified reference character "22" as to the toner supplying devices.

(Photoconductor Drum and Peripheral Members Thereof)

The photoconductor drum 3 is structured with an electrically conductive base and a photosensitive layer formed on a surface of the base. The photoconductor drum 3 is a cylindrical member that forms a latent image by electrification and exposure. The photoconductor drum 3 exhibits electrical conduction as being illuminated by a light beam, whereby an electrical image called an electrostatic latent image is formed on the surface of the photoconductor drum 3.

The photoconductor drum 3 is supported by not-shown drive means such that it can rotate about its axis.

As the charger 5, a contact roller-type charger, a contact brush-type charger or a non-contact discharging type charger is used, to uniformly electrify the surface of the photoconductor drum 3 to a prescribed potential.

The exposure unit 1 allows a light beam corresponding to image data to pass between the charger 5 and the developing device 2, to illuminate the electrified surface of the photoconductor drum 3 to expose it thereby, such that an electrostatic latent image corresponding to the image data is formed on the surface of the photoconductor drum 3.

In the present embodiment, an exemplary case in which a laser scanning unit (LSU) provided with a laser emitter and reflection mirrors is shown as the exposure unit 1. On the other hand, arrays of light emitting elements such as EL (electroluminescence) or LED writing heads may also be used as the exposure unit 1.

(Developing Device)

Figure 2:
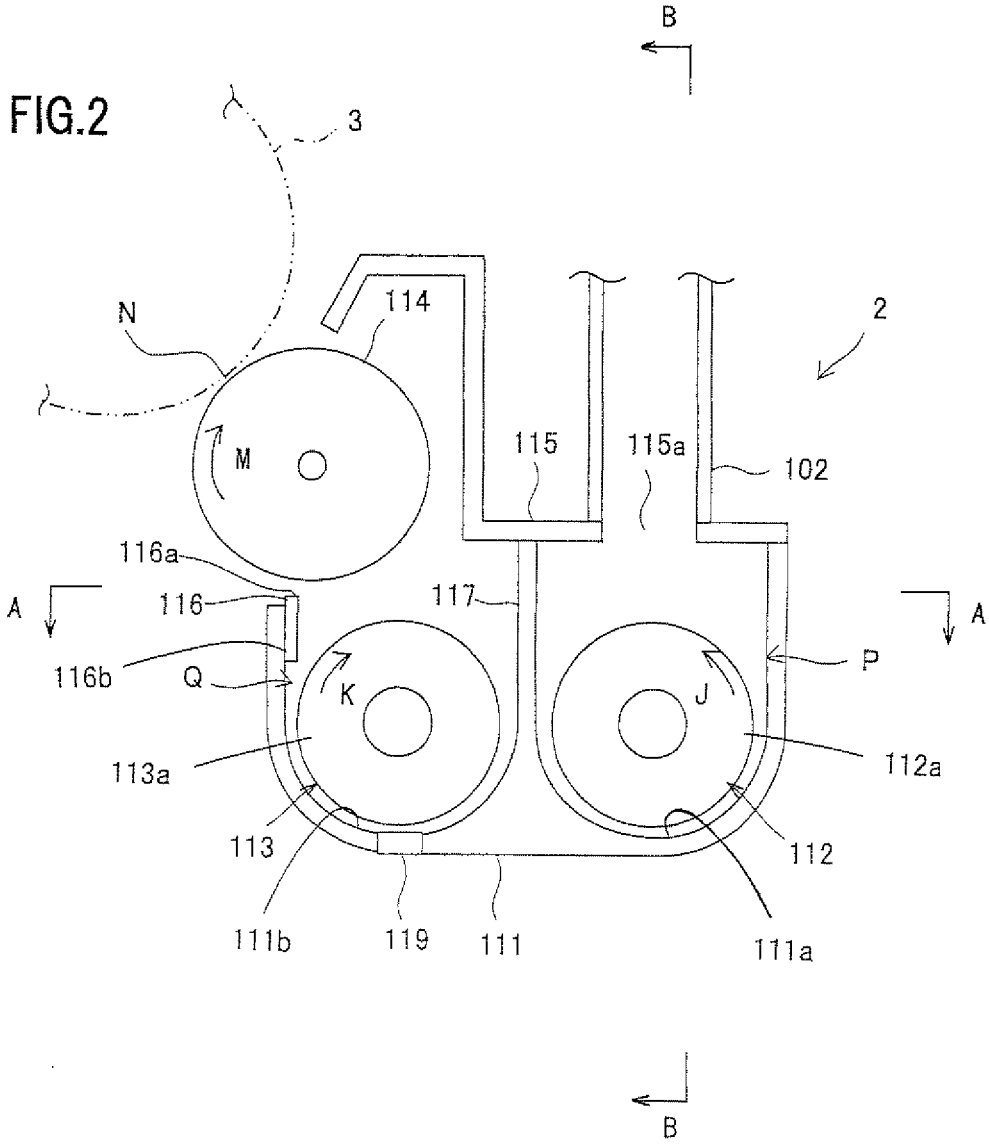
FIG. 2 is a schematic enlarged cross-sectional view of the developing device shown in FIG. 1.
Figure 3:
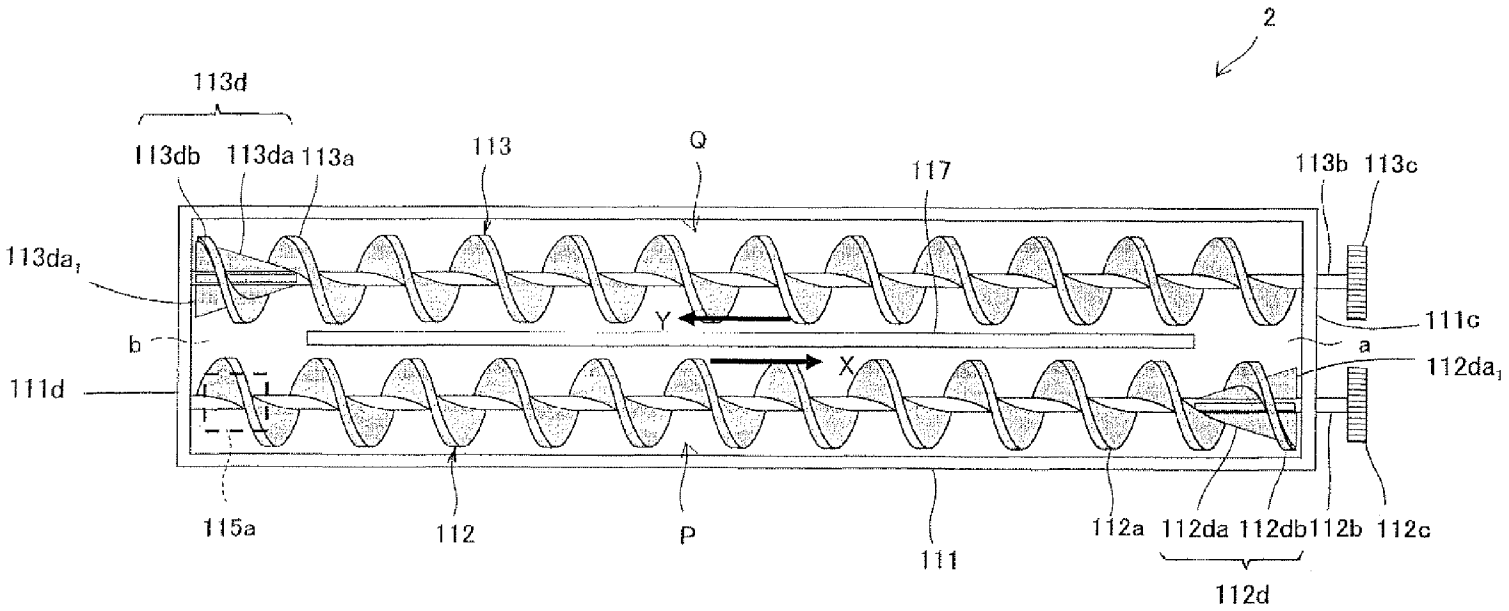
FIG. 3 is a cross-sectional view taken along a line A-A in FIG. 2.
Figure 4:
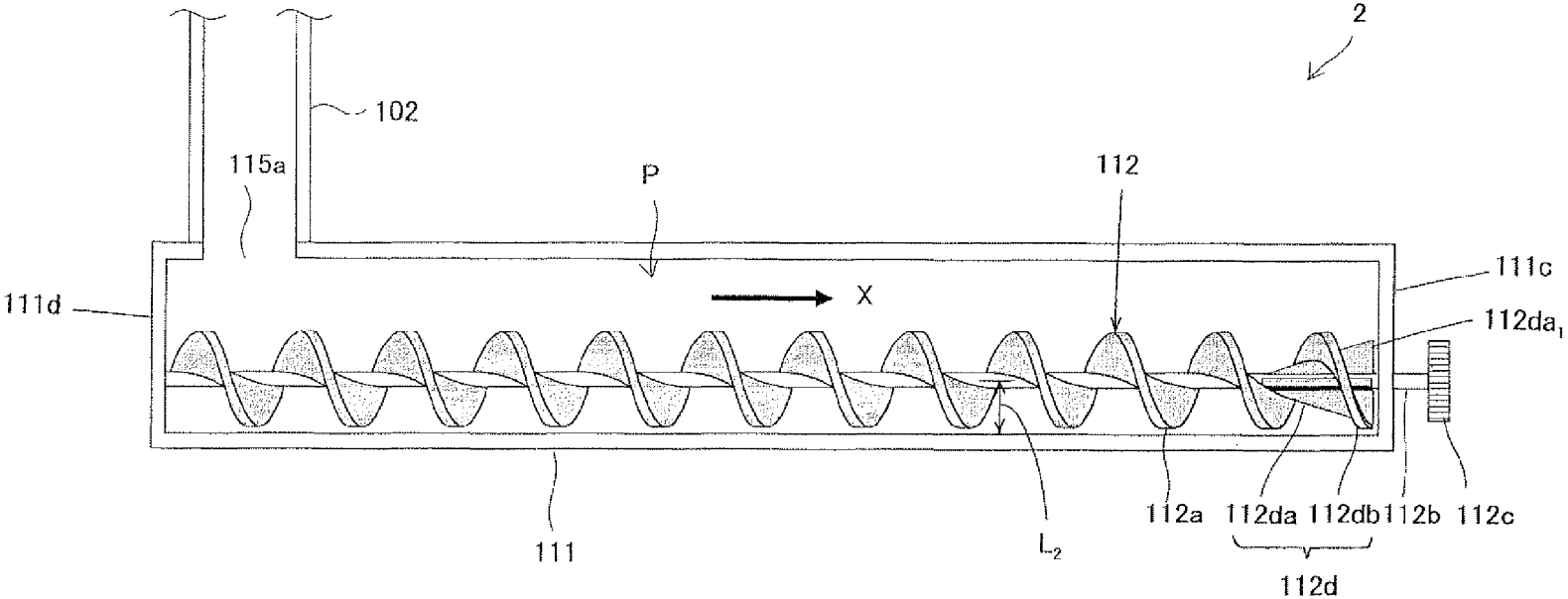
FIG. 4 is a cross-sectional view taken along a line B-B in FIG. 2.

FIG. 2 is a schematic enlarged cross-sectional view of the developing device shown in FIG. 1. FIG. 3 is a cross-sectional view taken along a line A-A in FIG. 2. FIG. 4 is a cross-sectional view taken along a line B-B in FIG. 2. A developer accommodated in a developer vessel 111 is not illustrated in these figures.

As shown in FIGS. 2 to 4, the developing device 2 includes: the developer vessel 111 being a container in a shape of substantial rectangular parallelepiped for accommodating a developer containing a toner and a carrier; a toner supply port 115*a* for supplying the developer vessel 111 with the toner; a developing roller 114 disposed in the developer vessel 111; first and second developer conveying passages P and Q disposed between a position in the developer vessel 111 where the toner is supplied and the developing roller 114; first and second communicating paths (a) and (b) formed at opposite ends of the first and second developer conveying passages P and Q for allowing both passages to communicate with each other; first and second developer conveying helical members 112 and 113 rotatably disposed in the first and second developer conveying passages P and Q; a doctor blade 116; and a toner concentration detecting sensor (permeability detecting sensor) 119. The developing device 2 visualizes (develops) an electrostatic latent image formed on the surface of the photoconductor drum 3 by supplying the toner to the surface of the photoconductor drum 3 by use of the developing roller 114.

The developer vessel 111 has its interior partitioned into two chambers by a partitioning plate 117 arranged in parallel to an axial direction of the developing roller 114. One of the two chambers associated with the toner supply port 115*a* is the first developer conveying passage P, and the other associated with the developing roller 114 is the second developer conveying passage Q. The first developer conveying passage P and the second developer conveying passage Q communicate each other by the first communicating path (a) and the second communicating path (b) at opposite ends in the axial direction. Thus, the first and second developer conveying passages P and Q and the first and second communicating paths (a) and (b) form one annular developer conveying passage.

The developer vessel 111 has semicylindrical interior wall faces 111*a* and 111*b* respectively constituting the first and second developer conveying passages P and Q.

The developer vessel 111 further includes a removable developer vessel cover 115 that forms a top wall of the developer vessel 111. The developer vessel cover 115 is provided with a toner supply port 115*a* upstream in a developer conveying direction (a direction of an arrow X) in the first developer conveying passage P for the purpose of supplying an unused toner.

The developer vessel 111 has an opening between a sidewall facing the second developer conveying passage Q and a bottom edge of the developer vessel cover 115. At the opening, the developing roller 114 is rotatably disposed so as to form a prescribed developing nip portion N with the photoconductor drum 3.

The developing roller 114 is a magnet roller that is rotated about its axis by not-shown drive means. The developing roller 114 carries the developer in the developer vessel 111 on its surface to supply the toner to the photoconductor drum 3. An application of a developing bias voltage from a not-shown power supply allows the toner to be supplied from the developer on the surface of the developing roller 114 to an electrostatic latent image on the surface of the photoconductor drum 3.

The doctor blade 116 is a rectangular plate-like member extending in parallel to the axial direction of the developing roller 114. A bottom end 116*b* is fixed to a bottom edge of the opening of the developer vessel 111, while its top end 116*a* is away from the surface of the developing roller 114 by a prescribed gap. The doctor blade 116 may be made of stainless steel, aluminum, synthetic resin or the like, for example.

<First Developer Conveying Helical Member>

The first developer conveying helical member (hereinafter sometimes referred to as the "first helical member") 112 is structured with a rotary shaft 112*b* disposed rotatably in the first developer conveying passage P and in parallel thereto, a helical blade 112*a* fixed to an outer circumferential surface of the rotary shaft 112*b*, an end blade 112*d* disposed on the rotary shaft 112*b* at one end of the helical blade 112*a*, and a gear 112*c* disposed at one end of the rotary shaft 112*b*, which penetrates one sidewall 111*c* of the developer vessel 111 in the longitudinal direction.

The end blade 112*d* includes a circumferential-direction agitating blade portion 112*da* having four projecting pieces 112$da_1$, and a helical blade portion 112*db* that is wound integral with the outer circumference of the circumferential-direction agitating blade portion 112*da* in the helical direction same as the helical direction of the helical blade 112*a*.

Figure 5:
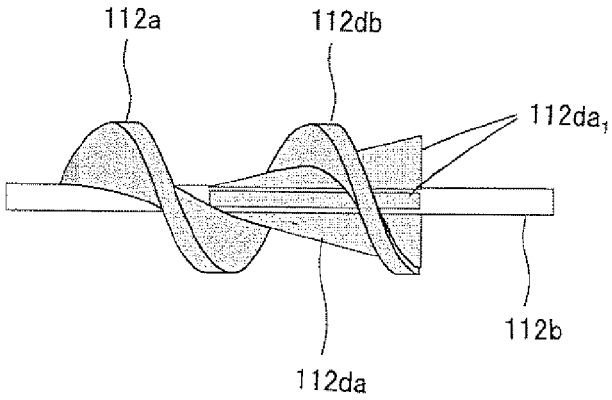
FIG. 5 is an enlarged view of an end blade of a first developer conveying helical member shown in FIG. 4.
Figure 6:
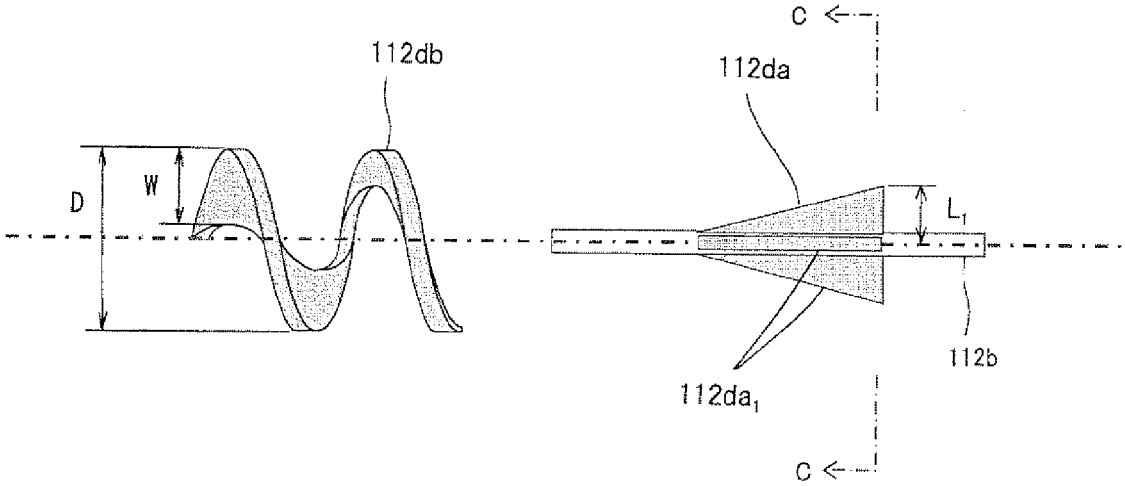
FIG. 6 is an exploded view of the end blade shown in FIG. 5.
Figure 7:
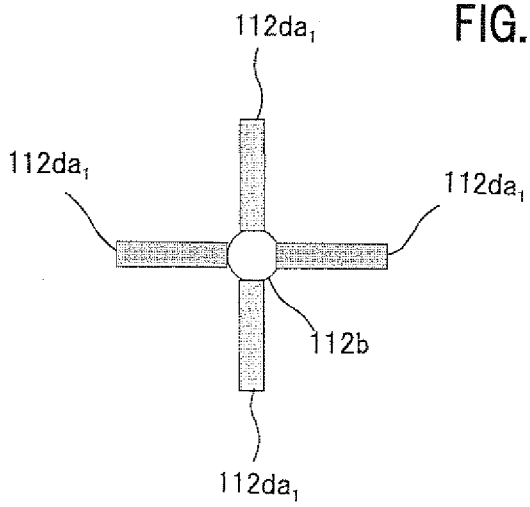
FIG. 7 is a view of a circumferential-direction agitating blade portion of the end blade taken along a line C-C in FIG. 6.
Figure 8:
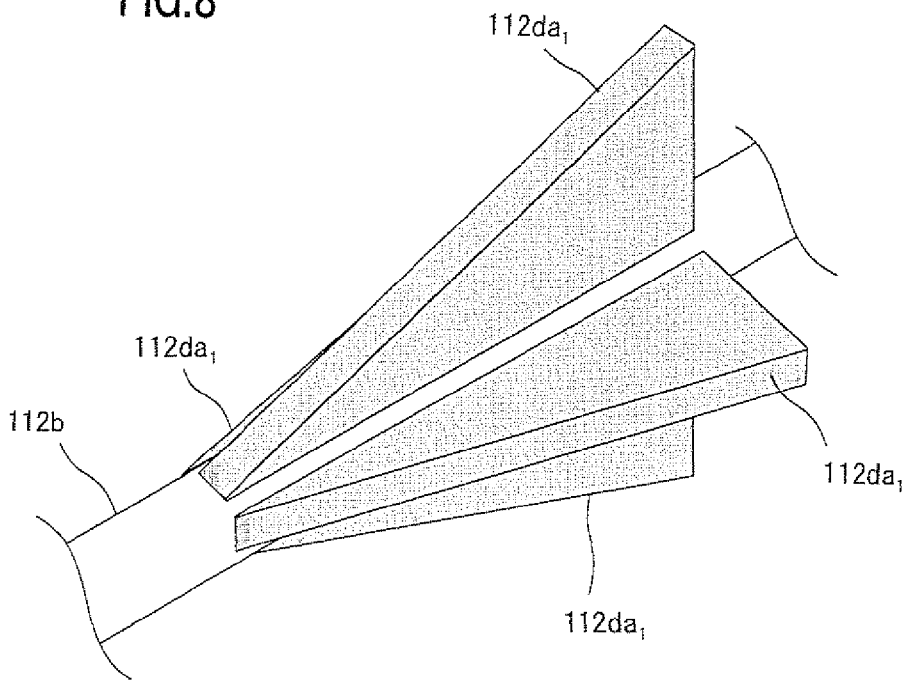
FIG. 8 is a perspective view of the circumferential-direction agitating blade portion shown in FIG. 6.

FIG. 5 is an enlarged view of the end blade of the first developer conveying helical member shown in FIG. 4. FIG. 6 is an exploded view of the end blade shown in FIG. 5. FIG. 7 is a view of the circumferential-direction agitating blade portion of the end blade taken along a line C-C in FIG. 6. FIG. 8 is a perspective view of the circumferential-direction agitating blade portion in FIG. 6.

The circumferential-direction agitating blade portion 112*da* includes four projecting pieces 112$da_1$, each having a shape of a right-angled triangle.

Each of the projecting pieces 112$da_1$ is arranged such that a long side of two sides making a right angle is attached along the rotary shaft 112*b*. The projecting pieces 112$da_1$ are arranged 90 degrees apart in the circumferential direction.

As shown in FIGS. 3 and 4, the circumferential-direction agitating blade portion 112*da* thus configured is formed such that the radial projecting size gradually increases toward the downstream side of the conveying direction (in the direction of the arrow X) in the first developer conveying passage P. The circumferential-direction agitating blade portion 112*da* is arranged at the position facing the first communicating path (a).

The maximum radial projecting size $L_1$ (see FIG. 6) of the projecting piece 112$da_1$ from the center of the rotary shaft 112*b* is set about 0.85 times a distance $L_2$ (see FIG. 4) from the center of the rotary shaft 112*b* to the semicylindrical interior wall face 111*a* of the first developer conveying passage P in the developer vessel 111.

As illustrated in FIGS. 3 to 6, the helical blade portion 112*db* has a constant outer diameter D, and a width W in the radial direction that is gradually decreased toward the downstream side in the conveying direction (the direction of the arrow X). The helical blade portion 112*db* is attached so as to be in contact with the outer periphery of the circumferential-direction agitating blade portion 112*da*.

Therefore, a gap is formed at the portion enclosed by the two adjacent projecting pieces 112$da_1$, the rotary shaft 112*b*, and the helical blade portion 112*db*. This gap may be closed by the helical blade portion 112*db*.

The helical blade portion 112*db* has the outer diameter, thickness and helical pitch, same as those of the helical blade 112*a*, and is continuously formed with the helical blade 112*a*.

The first helical member 112 is driven by not-shown drive means (e.g., a motor) through the gear 112*c*. The rotation of the helical blade 112*a* in a direction of an arrow J (see FIG. 2) conveys the developer in the first developer conveying passage P in the direction of the arrow X as shown in FIGS. 3 and 4.

In this case, the end blade 112*d* rotates in the same direction, wherein the projecting pieces 112$da_1$ of the circumferential-direction agitating blade portion 112*da* rotate toward the first communicating path (a) from above so as to agitate the developer in the circumferential direction, and the helical blade portion 112*db* conveys the developer toward one sidewall 111*c* of the developer vessel 111.

On the end blade 112*d*, the width W of the helical blade portion 112*da* in the radial direction gradually decreases, while the projecting size $L_1$ of the projecting piece 112$da_1$ gradually increases. Accordingly, the developer moving in the circumferential direction (in the direction of the arrow J) along the semicylindrical interior wall face 111*a* of the first developer conveying passage P increases more than the developer that is transferred toward one sidewall 111*c* of the developer vessel 111 to be pressed against the sidewall 111*c*.

Accordingly, the developing device according to the first embodiment can prevent the deterioration in the flow property of the developer, which deterioration is caused because the developer is pushed toward one sidewall 111*c* of the developer vessel 111 and receives a violent pressure as in the conventional case.

The developer around the rotating end blade 112*d* is pushed out to the first communicating path (a) by the developer sequentially conveyed from the upstream side of the first developer conveying passage P, and moves to the second developer conveying passage Q.

<Second Developer Conveying Helical Member>

The second developer conveying helical member (hereinafter sometimes referred to as the "second helical member") 113 has substantially the same structure as the first helical member 112, except that an end blade 113*d* same as the end blade 112*d* of the first helical member 112 is arranged at the downstream side (at the side of the second communicating path (b)) of the second developer conveying passage Q, and a helical blade 113*a* is arranged from the end blade 113*d* to the most upstream side of the second developer conveying passage Q (at the side of the first communicating path (a)).

The end blade 113 includes a circumferential-direction agitating blade portion 113*da* having four projecting pieces 113$da_1$, each of which has a projecting size increases toward the downstream side of the second developer conveying passage Q, and a helical blade portion 113*db* that is integrally wound around the outer circumference of the circumferential-direction agitating blade portion 113*da* in the helical direction same as that of the helical blade 113*a*.

The rotary shaft 113*b* penetrates through one sidewall 111*c* of the developer vessel 111 in terms of the longitudinal direction, and a gear 113*c* is attached to one end thereof so as to be adjacent to the gear 112*c*.

The helical direction of the helical blade 113*a* is the same as that of the helical blade 112*a*.

Therefore, when the helical blade 112*a* rotates in the direction of the arrow J through the gear 112*c* and the rotary shaft 112*b*, and the helical blade 113*a* synchronously rotates in a direction of an arrow K, which is reverse to the direction of the arrow J, through the gear 113*c* and the rotary shaft 113*b* by the not-shown drive means, the developer conveyed to the most upstream side of the second developer conveying passage Q from the first developer conveying passage P through the first communicating path (a) is conveyed to the end blade 113*d* in the direction of an arrow Y in the second developer conveying passage Q as shown in FIG. 3.

On the rotating end blade 113*d*, the projecting pieces 113$da_1$ of the circumferential-direction agitating blade portion 113*da* rotate toward the second communicating path (b) from above to agitate the developer in the circumferential direction, while the helical blade portion 113*db* conveys the developer toward the other sidewall 111*d* of the developer vessel 111.

In this case, the width in the radial direction of the helical blade portion 113*da* gradually decreases toward the downstream side of the second developer conveying passage Q, while the projecting size of the projecting piece 113$da_1$ gradually increases, whereby the developer moving in the circumferential direction (in the direction of the arrow K) along the semicylindrical interior wall face 111*b* of the second developer conveying passage Q increases more than the developer that moves to the other sidewall face 111*d* of the developer vessel 111 to be pressed against the sidewall face 111*d*.

Accordingly, the developing device according to the first embodiment can also prevent the deterioration in the flow property of the developer, which deterioration is caused because the developer is pushed toward the other sidewall 111*d* of the developer vessel 111 and receives a violent pressure as in the conventional case.

The developer around the rotating end blade 113*d* is pushed out to the second communicating path (b) by the developer sequentially conveyed from the upstream side of the second developer conveying passage Q, and moves to the first developer conveying passage P.

Thus, the developer circulates through the first developer conveying passage P and the second developer conveying passage Q.

A toner concentration detecting sensor 119 is mounted at a substantially central portion of the second developer conveying passage Q at the semicylindrical interior wall face 111*b* of the developer vessel 111 right below the second helical member 113, having its sensor face exposed inside the second developer conveying passage Q.

The toner concentration detecting sensor 119 is electrically connected to not-shown toner concentration control means.

The toner concentration control means exerts control in accordance with a toner concentration measurement value detected by the toner concentration detecting sensor 119, so as to rotate a toner discharging member 122 of a toner supplying device 22 (see FIG. 9), whose description will be given later, and to discharge the toner from a toner discharge port 123 to be supplied to the first developer conveying passage P of the developing device 2.

When the toner concentration control means determines that the toner concentration measurement value is lower than a toner concentration set value, a control signal is transmitted to drive means that rotates the toner discharging member 122, whereby the toner discharging member 122 rotates.

The toner concentration detecting sensor 119 may be a general toner concentration detecting sensor, such as a transmitted light detecting sensor, a reflected light detecting sensor, a permeability detecting sensor or the like. Of these, the permeability detecting sensor is preferable.

A not-shown power supply is connected to the permeability detecting sensor (toner concentration detecting sensor 119).

The power supply applies, to the permeability detecting sensor, a drive voltage for driving the permeability detecting sensor and a control voltage as an output of a detection result of the toner concentration to the control means.

The application of the voltages to the permeability detecting sensor by the power supply is controlled by the control means.

The permeability detecting sensor is of a type that receives the control voltage and outputs the detection result of the toner concentration as an output voltage value. Basically, the sensor exhibits an excellent sensitivity about the output center voltage value, and hence a control voltage capable of providing the output voltage around such a value is applied when used.

The permeability detecting sensor of such a type is commercially available. Examples thereof include those marketed under trade names TS-L, TS-A, and TS-K by TDK Corporation.

(Toner Supplying Device)

Figure 9:
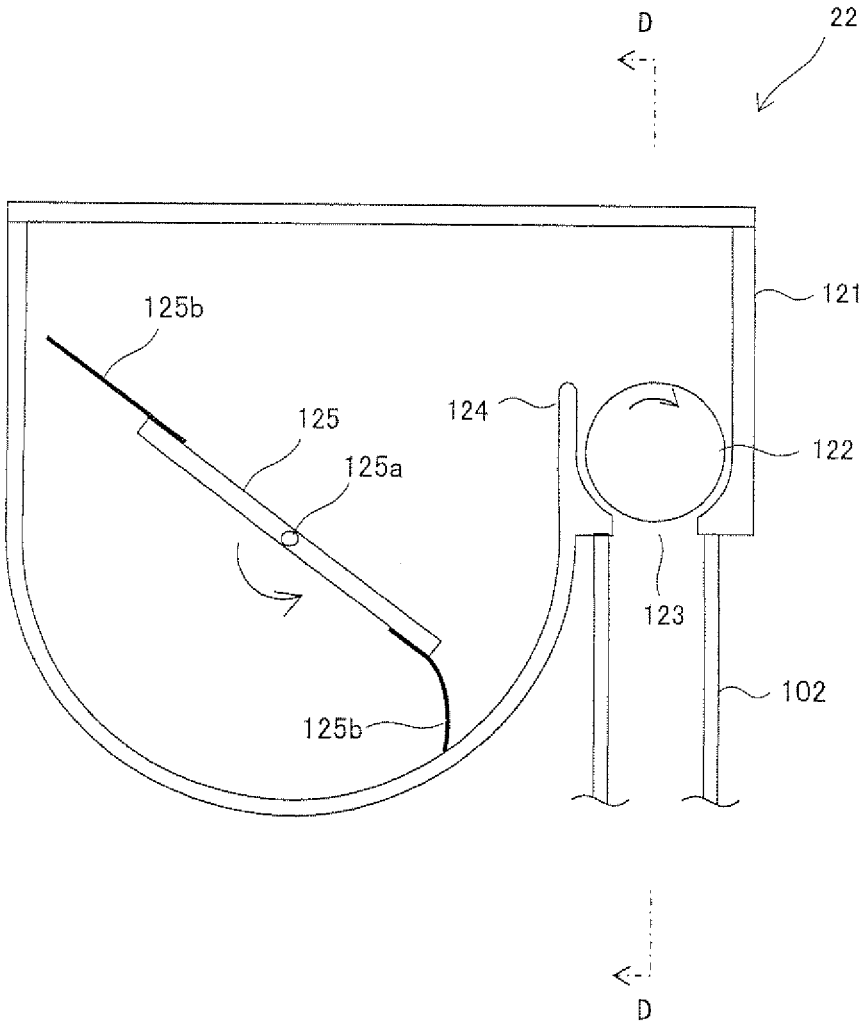
FIG. 9 is a schematic cross-sectional view of a toner supplying device of the developing device according to the first embodiment.
Figure 10:
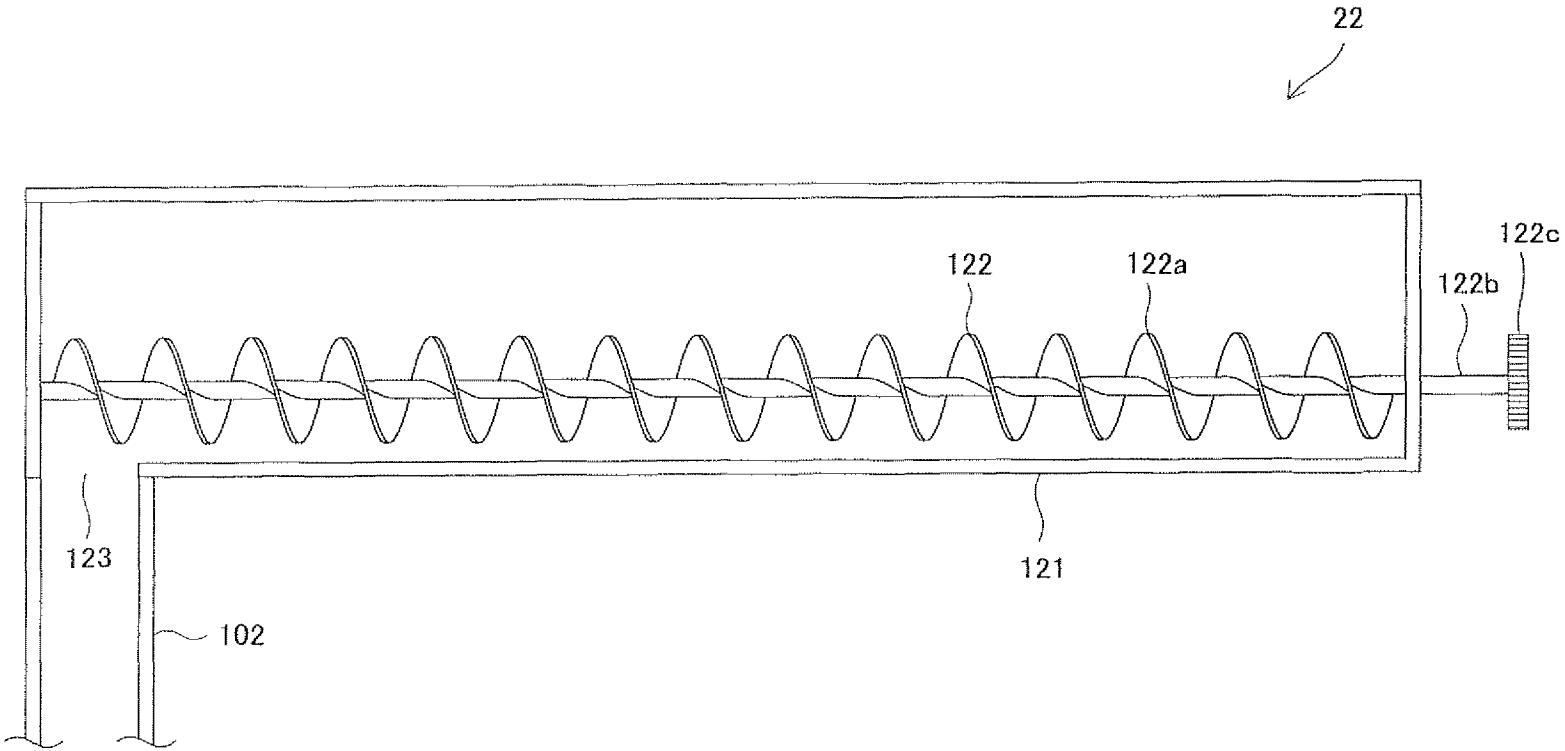
FIG. 10 is a cross-sectional view taken along a line D-D in FIG. 9.

FIG. 9 is a schematic cross-sectional view showing the toner supplying device in the developing device according to the first embodiment. FIG. 10 is a cross-sectional view taken along a line D-D in FIG. 9.

As shown in FIGS. 9 and 10, the toner supplying device 22 includes a toner container 121 having the toner discharge port 123, a toner agitating member 125, and the toner discharging member 122, and accommodates unused toner therein.

The toner supplying device 22 is disposed above the developer vessel 111 (see FIG. 1), having its toner discharge port 123 connected to the toner supply port 115*a* (see FIG. 2) of the developing device 2 by a toner conveying pipe 102.

The toner container 121 is a hollow substantially semicylindrical container. The toner discharge port 123 is disposed beside the circumference of the semicylindrical part.

The toner agitating member 125 is rotatably disposed at a substantially central position of the semicylindrical part of the toner container 121, and the toner discharging member 122 is rotatably disposed at a position above and near the toner discharge port 123.

The toner agitating member 125 is a plate-like member that rotates about a rotary shaft 125*a*, and has a sheet-like toner draw-up member 125*b* made of an elastic resin (e.g., polyethylene terephthalate) at each opposite tip away from the rotary shaft 125*a*. In this case, the rotary shaft 125*a* is rotatably supported at opposite sidewalls of the toner container 121 in terms of the longitudinal direction. One end of the rotary shaft 125*a* penetrates through the sidewall. A gear meshing with a drive gear of not-shown drive means is fixed to the one end.

As the toner draw-up member 125*b* of the toner agitating member 125 rotates from the bottom toward the top relative to the toner discharge port 123, the toner accommodated in the toner container 121 is drawn up while being agitated, and conveyed to the toner discharging member 122.

In this case, the elasticity of the toner draw-up member 125*b* allows the toner draw-up member 125*b* to slidably rotate as being deformed along the interior wall of the toner container 121, to thereby supply the toner toward the toner discharging member 122.

It is to be noted that a partition wall 124 is provided between the toner discharging member 122 and the toner agitating member 125, such that the toner drawn up by the toner agitating member 125 can be retained by an appropriate amount around the toner discharging member 122.

The toner discharging member 122 is structured with a rotary shaft 122*b* having its opposite ends rotatably supported at opposite sidewalls of the toner container 121 in terms of the longitudinal direction, a helical blade 122*a* fixed to an outer circumferential surface of the rotary shaft 122*b*, and a gear 122*c* fixed to one end of the rotary shaft 122*b* penetrating through the sidewall of the toner container 121.

The gear 122*c* meshes with a drive gear of not-shown drive means.

The toner discharge port 123 of the toner container 121 is arranged at one end opposite to the gear 122*c* of the helical blade 122*a*.

A rotation of the toner discharging member 122 allows the toner supplied around the toner discharging member 122 to be conveyed by the helical blade 122*a* toward the toner discharge port 123, and to be supplied from the toner discharge port 123 into the developer vessel 111 via the toner conveying pipe 102.

<Operation of Developing Device>

In a developing step with the image forming apparatus, as shown in FIGS. 2 to 4, the developing roller 114, the first helical member 112, and the second helical member 113 of the developing device 2 rotate in directions of indicated by arrows M, J, and K, respectively.

In this case, the developer in the first developer conveying passage P is conveyed in the arrow X direction by the first helical member 112, while the developer in the second developer conveying passage Q is conveyed in the arrow Y direction by the second helical member 113.

Simultaneously, the developer at the downstream side in the first developer conveying passage P is conveyed to the second developer conveying passage Q through the first communicating path (a), while the developer at the downstream side in the second developer conveying passage Q is conveyed to the first developer conveying passage P through the second communicating path (b).

In this manner, the developer in the developer vessel 111 circulates through the first developer conveying passage P and the second developer conveying passage Q, whereby the toner in the developer is sufficiently electrified through a frictional rub with the carrier.

The developer moving in the second developer conveying passage Q is partially supplied to the developing roller 114.

The developer supplied to the developing roller 114 is sent to the photoconductor drum 3 by the doctor blade 116 in a form of a uniform developer layer having a prescribed thickness on the outer circumferential surface of the developing roller 114. From the developer layer, the toner is partially supplied to the photoconductor drum 3. Thereafter, the developer whose toner concentration is lowered on the developing roller 114 is blended with the developer in the second developer conveying passage Q.

Accordingly, the toner concentration of the developer in the second developer conveying passage Q gradually becomes low.

Because the toner concentration of the developer in the second developer conveying passage Q is detected by the toner concentration detecting sensor 119, when the toner concentration becomes smaller than a prescribed value, the unused toner is supplied from the toner supplying device 22 onto the developer (existing developer) in the first developer conveying passage P. The supplied toner is blended with the existing developer, and dispersed by the rotation of the first helical member 112.

(Intermediate Transfer Belt Unit and Intermediate Transfer Belt Cleaner Unit)

As shown in FIG. 1, the intermediate transfer belt unit 8 disposed above the photoconductor drums 3 includes an intermediate transfer belt 7, intermediate transfer rollers 6*a*, 6*b*, 6C, and 6*d* (hereinafter, the description will collectively be given employing a unified reference character "6") for suspending the intermediate transfer belt 7 in a tense state to rotate the same in an arrow B direction in FIG. 1, a drive roller 71, a driven roller 72 and a belt tensioning mechanism (not-shown), and a transfer roller 11 disposed beside and in proximity to the drive roller 71.

It is to be noted that the intermediate transfer rollers 6 are each rotatably supported by a roller mounting portion of the belt tensioning mechanism.

Further, the intermediate transfer belt cleaner unit 9 is disposed next to the driven roller 72 of the intermediate transfer belt unit 8.

The drive roller 71 and the driven roller 72 are disposed externally to the outmost photoconductor drums 3, respectively, out of the four photoconductor drums 3, so that the intermediate transfer belt 7 is brought into contact with the photoconductor drums 3.

The intermediate transfer belt 7 is formed in an endless manner using a film having a thickness of about 100 to 150 μm, for example. The toner images of different color components formed on respective photoconductor drums 3 are successively transferred one over another on the external face of the intermediate transfer belt 7, to form a full-color toner image (multi-color toner image).

A transfer operation of the toner image from the photoconductor drums 3 to the intermediate transfer belt 7 is carried out by the intermediate transfer rollers 6 which are in contact with an internal face of the intermediate transfer belt 7.

Each intermediate transfer roller 6 is made up of a metal shaft (e.g., made of stainless steel) having a diameter of, e.g., 8 to 10 mm, and a conductive elastic material layer coating the outer circumferential surface of the metal shaft.

Examples of the conductive elastic material layer include ethylene propylene diene terpolymer (EPDM), foamed urethane or the like that contains a conductive material such as carbon black.

A high-voltage transfer bias (a high voltage whose polarity is opposite (+) to a polarity (−) of the electrostatic charge on the toner) is applied to the metal shaft of each of the intermediate transfer rollers 6 for transferring the toner images, whereby the intermediate transfer rollers 6 can uniformly apply a high voltage to the intermediate transfer belt 7.

While intermediate transfer rollers 6 are used as transfer electrodes in the present embodiment, brushes or the like can be used instead.

The toner image overlaid on the external surface of the intermediate transfer belt 7 shifts to a position of the transfer roller 11 (transfer portion) by the rotation of the intermediate transfer belt 7.

On the other hand, a recording medium is also conveyed through the sheet conveying path S to the transfer portion, where the recording medium is pressed against the intermediate transfer belt 7 by the transfer roller 11. Thus, the toner image on the intermediate transfer belt 7 is transferred onto the recording medium.

In this case, the intermediate transfer belt 7 and the transfer roller 11 are pressed against each other at a prescribed nip, while a high voltage is applied to the transfer roller 11 for transferring the toner image onto the recording medium. In this case, a polarity of the high voltage is opposite (+) to the polarity (−) of the electrostatic charge on the toner.

Further, in order to constantly obtain the nip between the intermediate transfer belt 7 and the transfer roller 11, one of the transfer roller 11 and the drive roller 71 is formed of a hard material such as metal, and the other is formed of a soft material such as rubber, foamed resin or the like.

The toner having not been transferred from the intermediate transfer belt 7 to the recording medium and remaining on the intermediate transfer belt 7 may cause undesired blend of toners of different colors when overlaying a new toner image on the intermediate transfer belt 7, and hence the remaining toner is removed and collected by the intermediate transfer belt cleaner unit 9.

The intermediate transfer belt cleaner unit 9 includes a cleaning blade in contact with the intermediate transfer belt 7 to remove the remaining toner, and a toner collector that collects the removed toner. It is noted that a portion in the intermediate transfer belt 7 which is brought into contact with the cleaning blade is supported by the driven roller 72.

(Sheet Conveying Path and Peripheral Member Thereof)

As shown in FIG. 1, the sheet conveying path S extends from the sheet feeding tray 10 and the manual sheet feeding tray 20, passing through the fusing device 12 whose description will be given later, to reach the sheet exit tray 15. Along the sheet conveying path S, pickup rollers 16*a* and 16*b*, feed rollers 25*a* to 25*f* (hereinafter, the description will collectively be given employing a unified reference character "25"), a registration roller 14, the transfer roller 11, the fusing device 12 and the like are disposed.

The feed rollers 25 are small rollers for facilitating and assisting sheet conveyance, and paired along the sheet conveying path S.

The pickup roller 16*a* is disposed at an end portion of the sheet feeding tray 10, to pick up sheet-like recording media (recording sheets) one by one from the feed tray 10 and supplies it to the sheet conveying path S.

The pickup roller 16*b* is disposed near the manual sheet feeding tray 20, to pick up the recording media one by one from the manual sheet feeding tray 20 and supplies it to the sheet conveying path S.

The registration roller 14 temporarily holds the recording medium conveyed on the sheet conveying path S, and delivers the recording medium to the transfer portion at a timing intended to align a tip of the toner image on the intermediate transfer belt 7 with a tip of the recording medium.

[Fusing Device Housing]

As shown in FIG. 1, the fusing device 12 accommodated in the fusing device housing 100B includes a heat roller 81 and a pressure roller 82 that rotate in directions opposite to each other while clamping the recording medium carrying the transferred toner image thereon, a feed roller 25*b*, and a feed (sheet exit) roller 25*c*.

The heat roller 81 is controlled by a not-shown controller such that it reaches a prescribed fusing temperature. The controller controls the temperature of the heat roller 81 based on a detection signal received from a not-shown temperature detector.

The heat roller 81 having reached the fusing temperature and the pressure roller 82 press against the recording medium to melt the toner, whereby the toner image is fused on the recording medium.

The recording medium having the toner image fused thereon is conveyed by the feed rollers 25*b* and 25*c* to take a turn-over sheet exit route of the sheet conveying path S, and ejected on the sheet exit tray 15 as being turned over (i.e., the toner image facing down).

Second Embodiment

Figure 11:
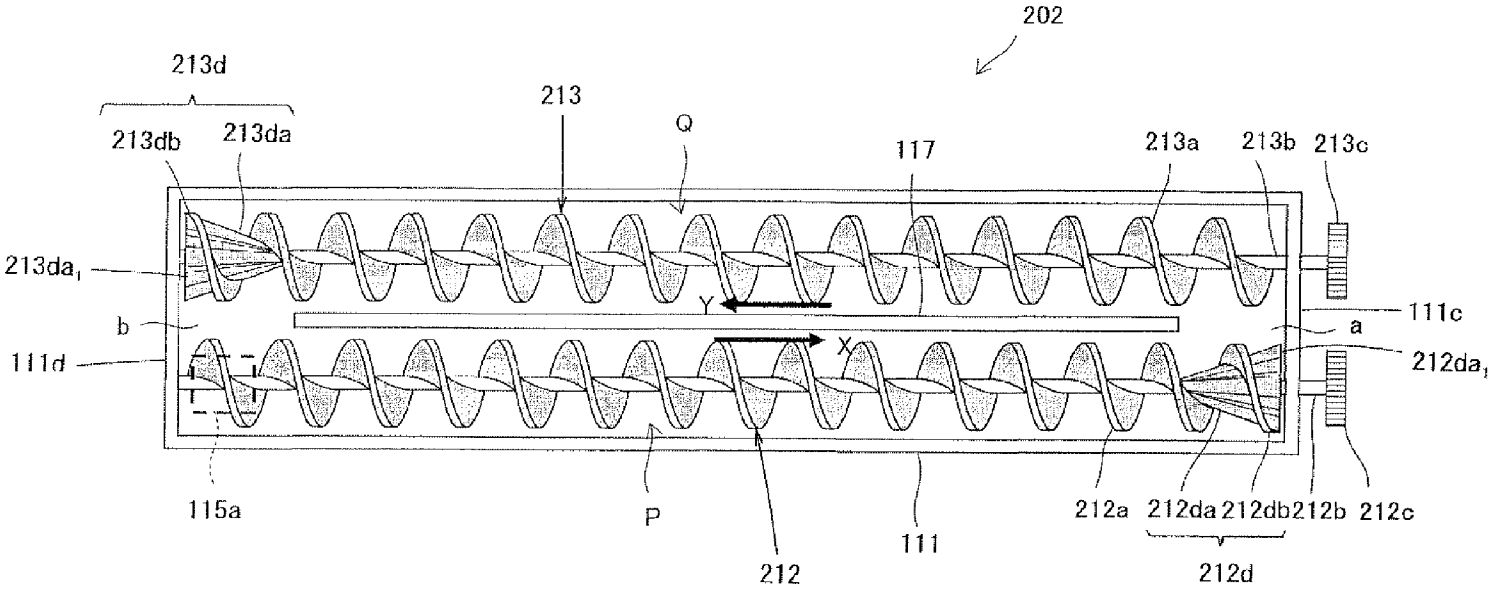
FIG. 11 is a horizontal cross-sectional view showing a developing device according to a second embodiment of the present invention.
Figure 12:
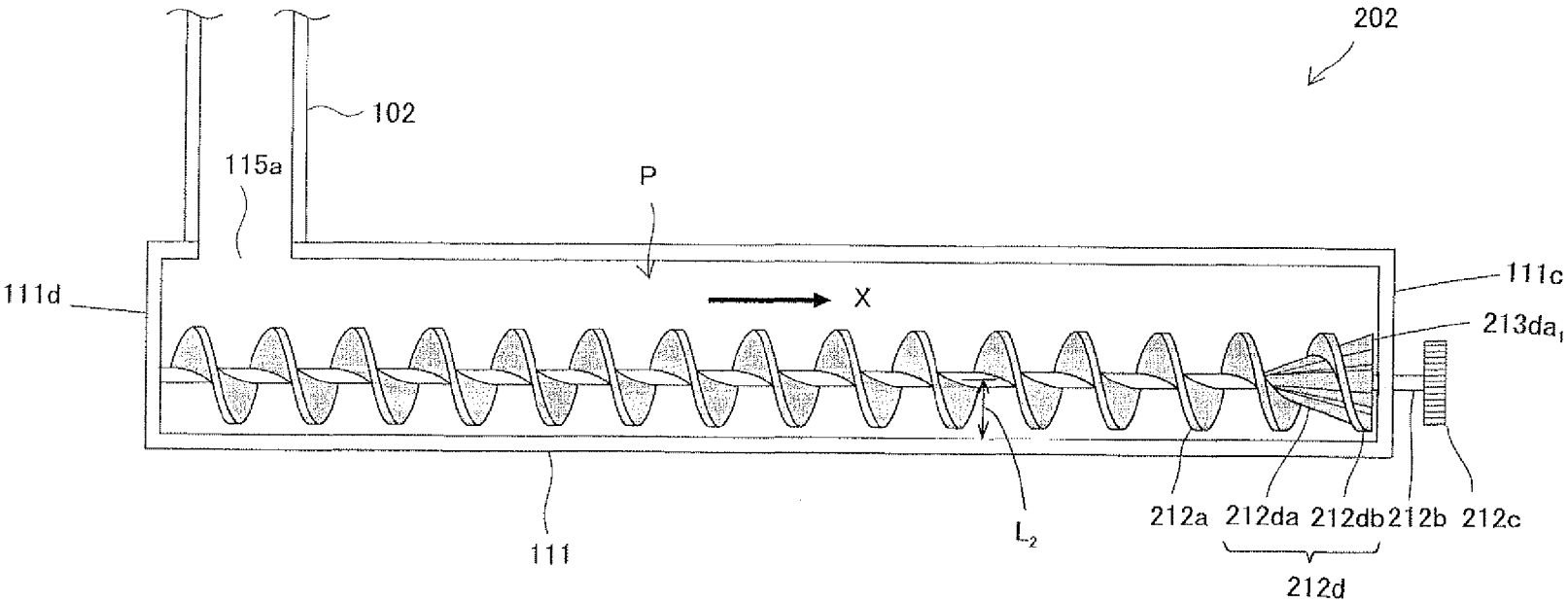
FIG. 12 is a side cross-sectional view of the developing device according to the second embodiment.
Figure 13:
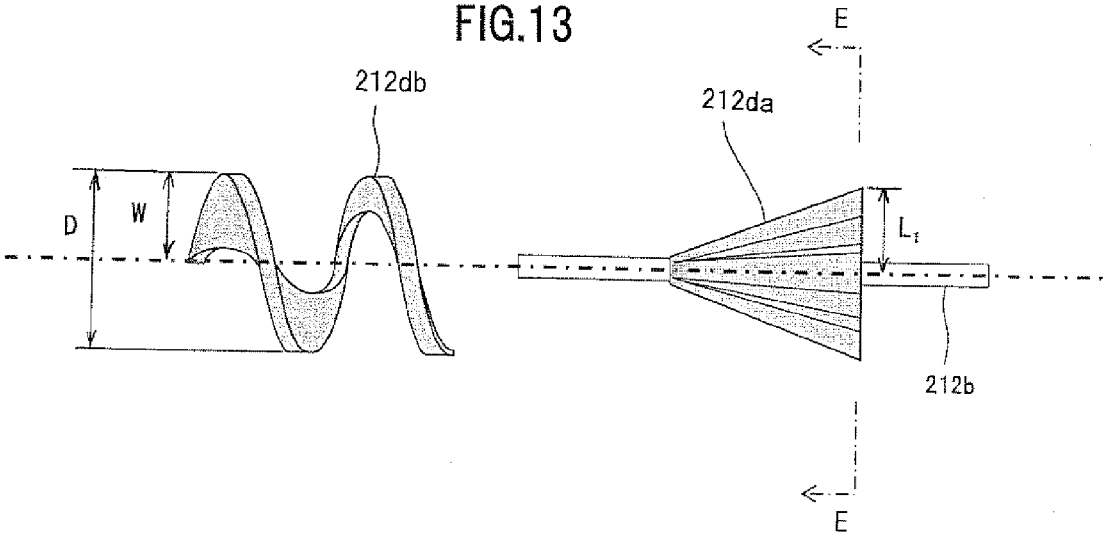
FIG. 13 is an exploded view of an end blade of a first developer conveying helical member shown in FIG. 12.
Figure 14:
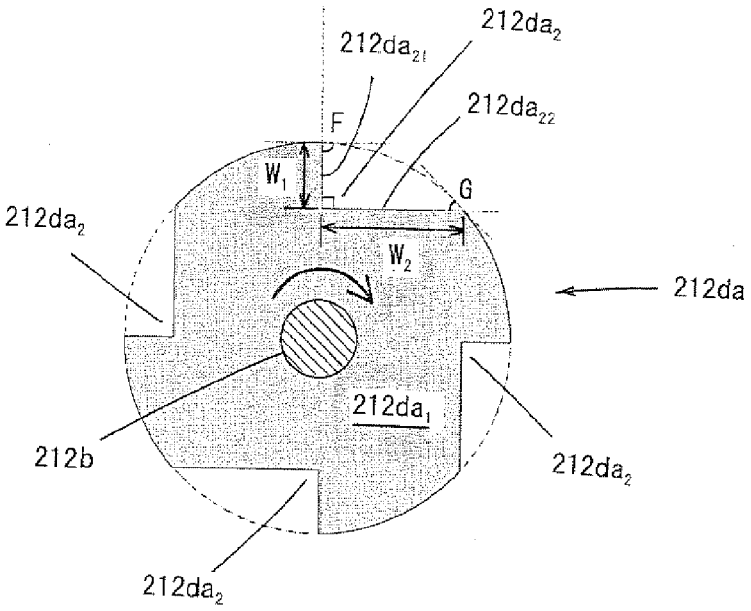
FIG. 14 is a view of a circumferential-direction agitating blade portion of the end blade taken along a line E-E in FIG. 13.
Figure 15:
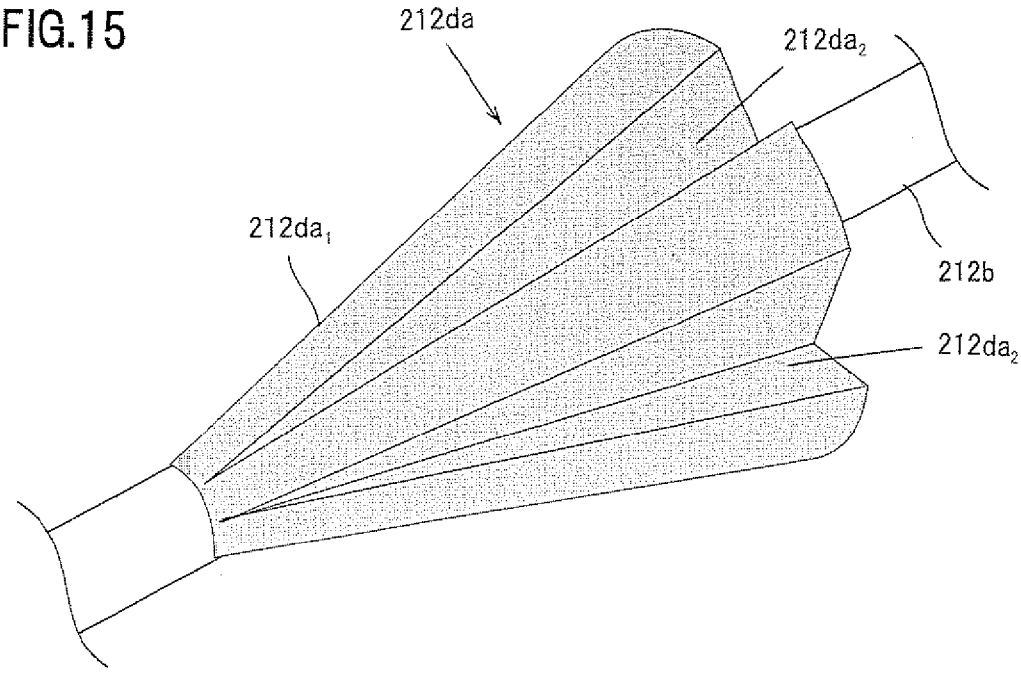
FIG. 15 is a perspective view of the circumferential-direction agitating blade portion shown in FIG. 14.

FIG. 11 is a horizontal cross-sectional view showing a developing device according to a second embodiment of the present invention. FIG. 12 is a side cross-sectional view of the developing device according to the second embodiment. FIG. 13 is an exploded view of an end blade of a first developer conveying helical member shown in FIG. 12. FIG. 14 is a view of a circumferential-direction agitating blade portion of the end blade taken along a line E-E in FIG. 13. FIG. 15 is a perspective view of the circumferential-direction agitating blade portion shown in FIG. 14. The components in FIGS. 11 and 12 same as those in FIGS. 3 and 4 are identified by the same numerals.

A developing device 202 according to the second embodiment is the same as the developing device according to the first embodiment, except for end blades 212*d* and 213*d* of a first developer conveying helical member 212 and a second developer conveying helical member 213. Therefore, a description will be given hereinafter mainly of the difference from the first embodiment.

<First Developer Conveying Helical Member>

The end blade 212 of the first developer conveying helical member 212 includes a circumferential-direction agitating blade portion 212*da* and a helical blade portion 212*db*, as in the first embodiment, but the structure of the circumferential-direction agitating blade portion 212*da* is different from the circumferential-direction agitating blade portion 112*da* in the first embodiment.

The circumferential-direction agitating blade portion 212*da* includes a conic part $\mathbf{212}da_1$ that is mounted to the rotary shaft 212*b* in such a manner that its outer diameter gradually increases toward the downstream side in the conveying direction (in the direction of the arrow X), and plural notches $\mathbf{212}da_2$ that are formed on the outer peripheral surface of the conic part $\mathbf{212}da_1$ with a prescribed space so as to extend in an axial direction.

The conic part $\mathbf{212}da_1$ has a structure in which four notches $\mathbf{212}da_2$ are formed on the outer peripheral surface of a frustum of a cone so as to form a central angle of 90° between adjacent one of the notches $\mathbf{212}da_2$. The central axis of the conic part $\mathbf{212}da_1$ agrees with the center of the rotary shaft 212*b*.

Each of the notches $\mathbf{212}da_2$ has a first internal face $\mathbf{212}da_{21}$ that is vertical to the rotating direction (in the direction of an arrow in FIG. 14) of the rotary shaft 212*b*, and a second internal face $\mathbf{212}da_{22}$ that is at right angles to the first internal face $\mathbf{212}da_{21}$. Each of the notches $\mathbf{212}da_2$ is formed to have an L-shaped cross-section.

In other words, the first internal face $\mathbf{212}da_{21}$ is arranged on a radial line with the center of the rotary shaft 212 being defined as a center, while the second internal face $\mathbf{212}da_{22}$ is arranged in the rotating direction of the rotary shaft 212*b* and is arranged as to be at right angles to the first internal face $\mathbf{212}da_{21}$.

Therefore, an angle F of the first internal face $\mathbf{212}da_{21}$ to a tangent line of an outer peripheral surface of the conic part

213$da_1$ is 90°, while an angle G of the second internal face 212$da_1$ to the tangent line of the outer peripheral surface of the conic part 213$da_1$ is 45°.

The notch 212$da_2$ may be formed to have a U-shaped cross-section in which the portion between the first internal face 212$da_{21}$ and the second internal face 212$da_{22}$ is formed into a curved face. Alternatively, the notch 212$da_2$ may be formed to have a V-shaped cross-section in which an angle between the first internal face 212$da_{21}$ and the second internal face 212$da_{22}$ is decreased to about 45°.

A width $W_1$ of the first internal face 212$da_{21}$ in the radial direction is set to be narrower than a width $W_2$ of the second internal face 212$da_{22}$ in the radial direction with a prescribed ratio. These widths $W_1$ and $W_2$ increase, as the diameter of the conic part 212$da_1$ increases. Specifically, the depth of the notch 212$da_2$ increases, as the diameter of the conic part 212$da_1$ increases.

A maximum radial projecting size (maximum radius) $L_1$ of the conic part 212$da_1$ from the center of the rotary shaft 212*b* is set to be about 0.85 times a distance $L_2$ from the center of the rotary shaft 212*b* to the semicylindrical interior wall face 111*a* of the first developer conveying passage P.

The helical blade portion 212*db*, which has the similar structure of the helical blade portion 112*db* in the first embodiment, is continuously wound and fixed on the outer peripheral surface of the conic part 212$da_1$ thus configured. In this case, a gap is formed between the helical blade portion 212*db* and the notch 212$da_2$. The helical blade part 212*db* may be formed so as to close this gap.

The rotating direction of the first helical member 212 is the same as the rotating direction of the first helical member 112 in the first embodiment, so that the rotary shaft 212*b* rotates such that the notches 212$da_2$ direct toward the first communicating path (a) from below. Specifically, the rotary shaft 212*b* rotates in such a manner that the first internal face 212$da_{21}$ of each of the notches 212$da_1$ pushes the developer.

The first helical member 212 is driven by not-shown drive means (e.g., a motor) through a gear 212*c*. The rotation of the helical blade 212*a* in the direction of the arrow J (see FIG. 2) conveys the developer in the first developer conveying passage P in the direction of the arrow X as shown in FIGS. 11 and 12.

In this case, the end blade 212*d* rotates in the same direction, wherein each of the notches 212$da_2$ of the circumferential-direction agitating blade portion 212*da* rotates toward the first communicating path (a) from above so as to agitate the developer in the circumferential direction, and the helical blade portion 212*db* conveys the developer toward one sidewall 111*c* of the developer vessel 111.

On the end blade 212*d*, the width W of the helical blade portion 212*da* in the radial direction gradually decreases toward the downstream side of the first developer conveying passage P, while the diameter of the conic part 212$da_1$ gradually increases. Therefore, the developer moving in the circumferential direction (in the direction of the arrow J) along the semicylindrical interior wall face 111*a* of the first developer conveying passage P increases more than the developer that is moved toward one sidewall 111*c* of the developer vessel 111 to be pressed against the sidewall 111*c*.

Since the diameter of the conic part 212$da_1$ increases toward the downstream side, the developer also receives a force in the direction of moving the developer in the radial direction along the outer peripheral surface of the conic part 212$da_1$.

Accordingly, the developing device according to the second embodiment can also prevent the deterioration in the flow property of the developer, which deterioration is caused because the developer is pushed toward one sidewall 111*c* of the developer vessel 111 and receives a violent pressure as in the conventional case.

The developer around the rotating end blade 212*d* is pushed out to the first communicating path (a) by the developer sequentially conveyed from the upstream side of the first developer conveying passage P, and moves to the second developer conveying passage Q.

<Second Developer Conveying Helical Member>

The second developer conveying helical member 213 has substantially the same structure as the first helical member 212, except that an end blade 213*b* same as the end blade 212*d* of the first helical member 212 is arranged at the downstream side (facing the second communicating path (b)) of the second developer conveying passage Q, and a helical blade 213*a* is arranged from the end blade 213*d* to the most upstream side of the second developer conveying passage Q (facing the first communicating path (a)).

The end blade 213 includes a circumferential-direction agitating blade portion 213*da* having a conic part 213$da_1$, whose diameter increases toward the downstream side of the second developer conveying passage Q, and four notches 213$da_2$; and a helical blade portion 213*db* that is integrally wound around the outer circumference of the circumferential-direction agitating blade portion 213*da*.

The helical blade portion 213*d* is continuously formed in the helical direction same as that of the helical blade 213*a*.

The rotary shaft 213*b* penetrates through one sidewall 111*c* of the developer vessel 111 in terms of the longitudinal direction, and a gear 313*c* is attached to one end thereof so as to be adjacent to the gear 212*c*.

The helical direction of the helical blade 313*a* is the same as that of the helical blade 112*a*.

Therefore, when the helical blade 212*a* rotates in the direction of the arrow J through the gear 212*c* and the rotary shaft 112*b*, and the helical blade 213*a* synchronously rotates in the direction of the arrow K, which is reverse to the direction of the arrow J, through the gear 213*c* and the rotary shaft 213*b* by the not-shown drive means, the developer conveyed to the most upstream side of the second developer conveying passage Q from the first developer conveying passage P through the first communicating path (a) is conveyed to the end blade 213*d* in the direction of the arrow Y in the second developer conveying passage Q as shown in FIG. 11.

On the rotating end blade 213*d*, the notches 212$da_2$ of the circumferential-direction agitating blade portion 213*da* rotate toward the second communicating path (b) from above to agitate the developer in the circumferential direction, while the helical blade portion 213*db* conveys the developer toward the other sidewall 111*d* of the developer vessel 111.

In this case, the width in the radial direction of the helical blade portion 213*da* gradually decreases toward the downstream side of the second developer conveying passage Q, while the diameter of the conic part 213$da_1$ increases, whereby the developer moving in the circumferential direction (in the direction of the arrow K) along the semicylindrical interior wall face 111*b* of the second developer conveying passage Q increases more than the developer that moves to the other sidewall face 111*d* of the developer vessel 111 to be pressed against the sidewall 111*d*.

Accordingly, the developing device according to the second embodiment can also prevent the deterioration in the flow property of the developer, which deterioration is caused because the developer is pushed toward the other sidewall 111*d* of the developer vessel 111 and receives a violent pressure as in the conventional case.

The developer around the rotating end blade 213*d* is pushed out to the second communicating path (b) by the developer sequentially conveyed from the upstream side of the second developer conveying passage Q, and moves to the first developer conveying passage P.

Thus, the developer circulates through the first developer conveying passage P and the second developer conveying passage Q.

What is claimed is:

1. A developing device to be installed in an electrophotographic image forming apparatus including a photoconductor drum that is to have an electrostatic latent image formed on a surface thereof, the developing device comprising:

a developer vessel that accommodates a developer containing a toner and a carrier; a toner supply port for supplying the toner into the developer vessel; a developing roller that is disposed in the developer vessel and that rotates while carrying the developer to supply the toner onto the surface of the photoconductor drum having the electrostatic latent image formed thereon; a developer conveying passage that is disposed between a position in the developer vessel where the toner is supplied and the developing roller; and a developer conveying helical member that is rotatably disposed in the developer conveying passage to convey the developer in the developer conveying passage to the developing roller, wherein the developer conveying passage includes: a first developer conveying passage associated with the toner supply port and a second developer conveying passage associated with the developing roller, the first developer conveying passage and the second developer conveying passage being defined by a partitioning plate extending in parallel to an axial direction of the developing roller; and a pair of communicating paths that establish a communication between the first developer conveying passage and the second developer conveying passage at opposite sides in the axial direction, and the developer conveying helical member includes a first developer conveying helical member disposed in the first developer conveying passage and a second developer conveying helical member disposed in the second developer conveying passage, wherein the first and second developer conveying helical members include a rotary shaft and a helical blade fixed to an outer peripheral surface of the rotary shaft, and at least one of the first and second developer conveying helical members includes an end blade at one end of the rotary shaft at a downstream side in a conveying direction of the developer, wherein the end blade includes a circumferential-direction agitating blade portion whose radial projecting size gradually increases toward the downstream side in the conveying direction; and a helical blade portion integrally wound around an outer periphery of the circumferential-direction agitating blade portion in the same helical direction as that of the helical blade, wherein, in the first and second developer conveying passages, the first and second developer conveying helical members convey the developer in directions opposite to each other, and the end blade agitates the developer in a circumferential direction of the rotary shaft at the downstream side in the conveying direction, such that the developer circulates through the first and second developer conveying passages.

2. The developing device according to claim 1, wherein both the first and second developer conveying helical members includes the end blade at one end at the downstream side in the conveying direction.

3. The developing device according to claim 1, wherein the circumferential-direction agitating blade portion has plural projecting pieces provided on the rotary shaft with a predetermined space in the circumferential direction, and radial projecting size of each of these projecting pieces gradually increases toward the downstream side in the conveying direction.

4. The developing device according to claim 3, wherein the number of the projecting pieces is two to four.

5. The developing device according to claim 3, wherein the developer vessel includes the semicylindrical interior wall faces, each constituting the first and second developer conveying passages, a maximum radial projecting size of the projecting piece from the center of the rotary shaft is set to be 0.8 to 0.9 times the distance from the center of the rotary shaft to the semicylindrical interior wall face.

6. The developing device according to claim 1, wherein the rotary shaft rotates such that the projecting pieces direct toward the communicating path from above.

7. The developing device according to claim 1, wherein the circumferential-direction agitating blade portion has a conic part provided to the rotary shaft in such a manner that the outer diameter thereof gradually increases toward the downstream side in the conveying direction; and has plural notches that are formed on the outer peripheral surface of the conic part with a prescribed space in the circumferential direction so as to extend in the axial direction of the rotary shaft.

8. The developing device according to claim 7, wherein the notch has a vertical internal face with respect to the rotating direction of the rotary shaft.

9. The developing device according to claim 7, wherein the notch has a shape of the cross-section parallel to the vertical surface with respect to the axial direction of the rotary shaft include a V-shaped cross-section, L-shaped cross-section, or U-shaped cross-section.

10. The developing device according to claim 7, wherein the number of the notches is two to four.

11. The developing device according to claim 7, wherein the developer vessel includes the semicylindrical interior wall faces, each constituting the first and second developer conveying passages, the maximum radial projecting size of the conic part from the center of the rotary shaft is set to be 0.8 to 0.9 times the distance from the center of the rotary shaft to the semicylindrical interior wall face.

12. The developing device according to claim 7, wherein the rotary shaft rotates such that the notches direct toward the communicating path from above.

13. The developing device according to claim 1, wherein the helical blade portion of the end blade has a constant outer diameter, and has a width in the radius direction that gradually decreases toward the downstream side in the conveying direction.

14. An image forming apparatus comprising: a photoconductor drum that is to have an electrostatic latent image formed on a surface thereof; a charging device that electrifies the surface of the photoconductor drum; an exposure device that forms the electrostatic latent image on the surface of the photoconductor drum; the developing device according to claim 1 which supplies a toner to the electrostatic latent image on the surface of the photoconductor drum to form a toner image; a toner supplying device that supplies the toner to the developing device; a transferring device that transfers the toner image on the surface of the photoconductor drum to a recording medium; and a fusing device that fuses the toner image on the recording medium.

* * * * *